US009697785B2

(12) United States Patent
Hong et al.

(10) Patent No.: US 9,697,785 B2
(45) Date of Patent: Jul. 4, 2017

(54) DISPLAY DEVICE

(75) Inventors: Jin Cheol Hong, Gumsi-si (KR); Hyun Taek Nam, Daegu (KR); Jong Woo Kim, Gumi-si (KR)

(73) Assignee: LG DISPLAY CO., LTD., Seoul (KR)

( * ) Notice: Subject to any disclaimer, the term of this patent is extended or adjusted under 35 U.S.C. 154(b) by 1001 days.

(21) Appl. No.: 12/318,281

(22) Filed: Dec. 23, 2008

(65) Prior Publication Data

US 2009/0213146 A1 Aug. 27, 2009

(30) Foreign Application Priority Data

Feb. 21, 2008 (KR) ..... 10-2008-0016030

(51) Int. Cl.
*G09G 5/10* (2006.01)
*G09G 3/36* (2006.01)
*G09G 3/20* (2006.01)

(52) U.S. Cl.
CPC ..... *G09G 3/3648* (2013.01); *G09G 3/3688* (2013.01); *G09G 3/2092* (2013.01); *G09G 2320/0238* (2013.01); *G09G 2320/0261* (2013.01); *G09G 2320/0276* (2013.01); *G09G 2370/047* (2013.01)

(58) Field of Classification Search
CPC ... G09G 2320/0238; G09G 2320/0261; G09G 2320/0276; G09G 2370/047; G09G 3/2092; G09G 3/3648; G09G 3/3688
USPC ..... 345/87–103
See application file for complete search history.

(56) References Cited

U.S. PATENT DOCUMENTS 7,154,461 B2 * 12/2006 Lin et al. ..... 345/90
2002/0003523 A1 * 1/2002 Pai ..... G09G 5/006 345/99
2003/0151616 A1 * 8/2003 Morita ..... 345/690
2004/0141094 A1 * 7/2004 Kumamoto et al. ..... 348/554
2006/0132406 A1 * 6/2006 Pan ..... G09G 3/2011 345/89
2007/0030230 A1 * 2/2007 Lee ..... G09G 3/3648 345/94
2008/0030615 A1 * 2/2008 Vasquez ..... G09G 3/2092 348/446
2008/0129907 A1 * 6/2008 Jun ..... G02F 1/13624 349/38
2008/0238854 A1 * 10/2008 Kimura ..... G09G 3/3648 345/98

* cited by examiner

*Primary Examiner* — Ilana Spar
*Assistant Examiner* — Brent D Castiaux
(74) *Attorney, Agent, or Firm* — Dentons US LLP

(57) ABSTRACT

Provided is a display device capable of improving image quality. The display device includes a display panel, a gate driver, a data driver and a gamma reference voltage generator. In the display panel, gate lines and data lines cross each other to define a plurality of liquid crystal cells. The gate driver supplies a scan signal to the gate lines sequentially. The data diver supplies a data voltage to the data lines. The gamma reference voltage generator selectively supplies a gamma reference voltage or a reference voltage of black gradation to the data driver in each horizontal period, according to a selection control signal input from the timing controller.

8 Claims, 4 Drawing Sheets

DISPLAY DEVICE

This application claims the benefit of Korean Patent Application No. 10-2008-0016030, filed on Feb. 21, 2008, which is hereby incorporated by reference for all purposes as if fully set forth herein.

BACKGROUND OF THE INVENTION

Field of the Invention

The present invention relates to a display device that can improve image quality.

Discussion of the Related Art

Various kinds of flat panel display devices that can replace heavy and bulky cathode ray tubes (CRTs) have been recently developed. Examples of the flat panel display devices are a liquid crystal display device, a field emission display device, a plasma display device, and an organic electro-luminescence display device.

Among the various kinds of display devices, a liquid crystal display device (LCD) is a device for displaying an image using a principle in which each pixel of a liquid crystal panel disposed on a front face of the LCD acts as a type of optical switch to selectively transmit a light generated from a light source of a backside thereof, e.g., a backlight unit. In comparison of a related art cathode ray tube (CRT) to an LCD, the related art CRT controls brightness by adjusting the intensity of an electron beam, whereas the LCD controls the brightness of image by adjusting the intensity of light generated from the light source.

Meanwhile, as the image technology has been developed more and more, technology which can display a motion picture as well as a still picture can be embodied in the LCD.

However, it is not easy to implement a motion picture well in the LCD. That is, since the response speed of a liquid crystal is slower than a frame period of the LCD, there occurs a motion blurring when applying a voltage newly in a next frame after a predetermined voltage, e.g., an image signal or a data voltage, previously charged at the liquid crystal is maintained for one frame. After all, the data of the previous frame has an effect on the data of the next frame, causing the motion blurring phenomenon to occur.

In particular, this motion blurring phenomenon strongly occurs when displaying the motion picture rather than the still picture.

FIG. 1 is a graph illustrating a light intensity versus a time in a related art CRT, and FIG. 2 is a graph illustrating a light intensity versus a time in a related art LCD.

Referring to FIG. 1, the CRT is driven by an impulse type. In this case, since the data is displayed for only an extremely short time during each frame period, the data displayed for only the extremely short time does not have an effect on a next frame period.

Referring to FIG. 2, the LCD is driven by a hold type. In this case, the data is continuously maintained for each frame period so that the data maintained during a previous frame period has an effect on a next frame period. Consequently, the motion blurring phenomenon inevitably occurs in the related art LCD which is driven by the hold type.

In order to prevent the motion blurring phenomenon, there has been proposed a black data insertion (BDI) method in which actual image data is applied only during a predetermined period of one frame and black data is applied during the other period of the one frame. Herein, the black data means the data voltage corresponding to a black gradation, e.g., 0 gradation. Therefore, the motion blurring phenomenon does not occur because each pixel displays the black gradation due to the black data.

FIG. 3 is a schematic view illustrating the BDI method in a related art LCD.

Referring to FIG. 3, an image data voltage and a black data voltage are alternatingly applied to a liquid crystal display panel during one frame period.

For instance, if there exist 488 number of gate lines, first to fifth gate lines are sequentially activated so that the image data voltage is applied to pixels of each activated gate line. Thereafter, the first to the fifth gate lines are activated again so that the black data voltage is applied to the pixels of each activated gate line.

Subsequently, sixth to tenth gate lines are activated so that the image data voltage is applied to pixels of each activated gate line and the image data is displayed on a screen. Afterwards, the sixth to the tenth gate lines are activated again so that the black data voltage is applied to the pixels of each activated gate line.

Such an operation is performed repeatedly for one frame period in which 488 number of gate lines are activated. Likewise, the same procedure is also performed during a next frame period.

In the related art LCD, the black data is supplied to a data driver after it is generated in a timing controller. That is, the black data is generated in the timing controller and various circuits should be additionally employed to provide the black data generated from the data driver to the liquid crystal display panel on a desired timing. As a result, the overall circuit becomes too complicated.

SUMMARY OF THE INVENTION

Accordingly, the present invention is directed to a liquid crystal display device that substantially obviates one or more of the problems due to limitations and disadvantages of the related art.

An advantage of the present invention is to provide a display device that can improve not only image quality but also the complexity of a circuit by black data insertion (BDI).

Additional advantages and features of the invention will be set forth in the description which follows and in part will be apparent from the description or may be learned from practice of the invention. These and other advantages of the invention may be realized and attained by the structure particularly pointed out in the written description and claims hereof as well as the appended drawings.

It is to be understood that both the foregoing general description and the following detailed description are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment(s) of the invention and together with the description serve to explain the principle of the invention.

DETAILED DESCRIPTION OF THE ILLUSTRATED EMBODIMENTS

Reference will now be made in detail to the embodiments of the present invention, examples of which are illustrated in the accompanying drawings.

In the following embodiments, description will be made taking a liquid crystal display device (LCD) as an example among various kinds of flat panel display devices.

Figure 1:
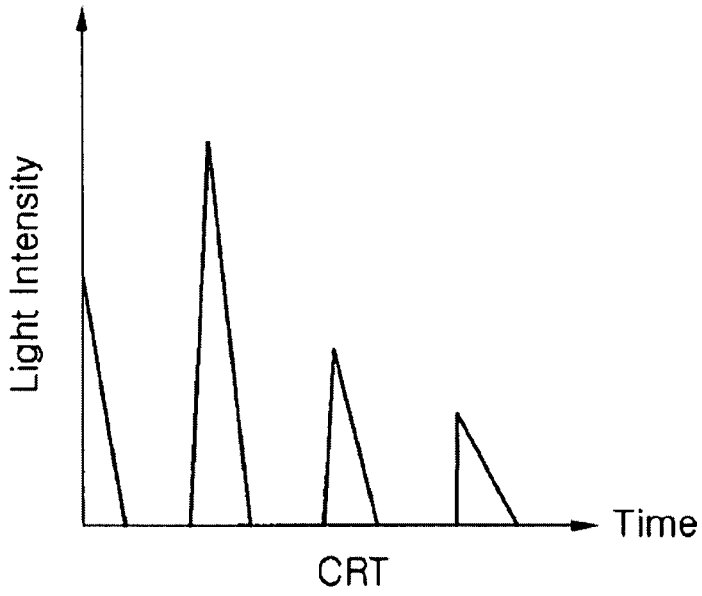
Fig. 1 (Prior Art)
FIG. 1 is a graph illustrating light intensity versus time in a related art cathode ray tube (CRT).
Figure 2:
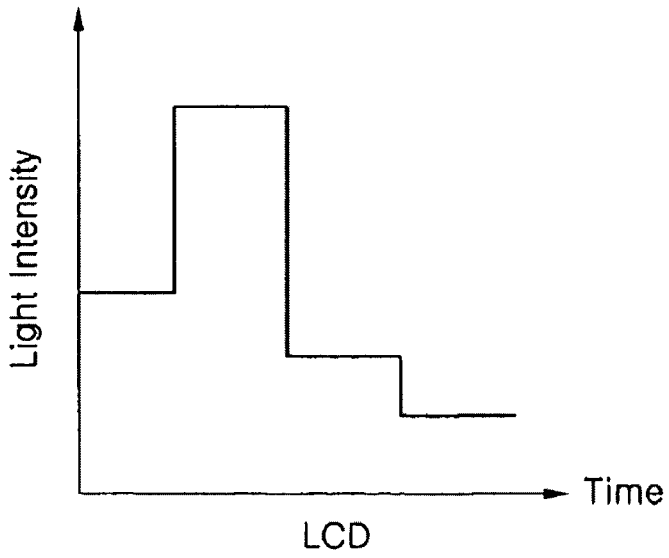
Fig. 2 (Prior Art)
FIG. 2 is a graph illustrating light intensity versus time in a related art liquid crystal display device (LCD).
Figure 3:
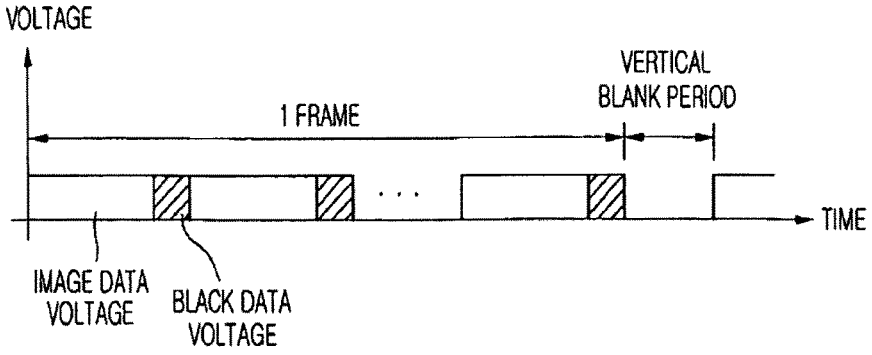
Fig. 3 (Prior Art)
FIG. 3 is a schematic view illustrating a black data insertion (BDI) method in a related art LCD.
Figure 4:
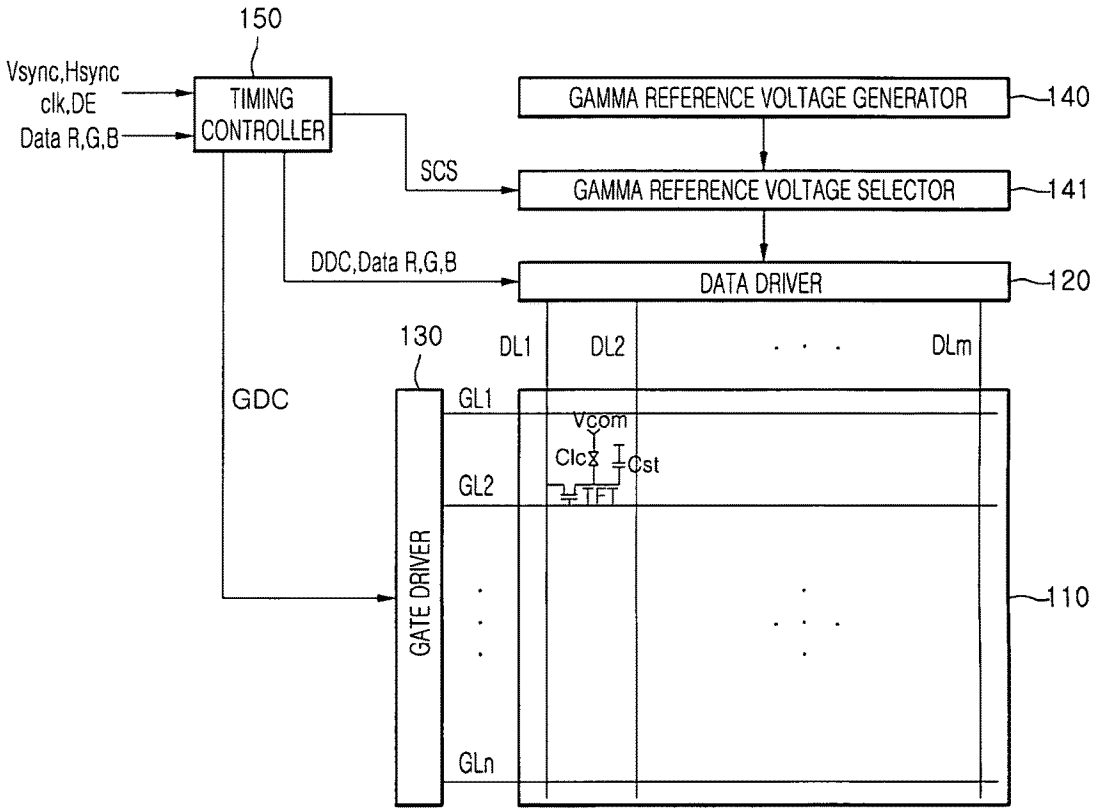
FIG. 4 is a schematic view illustrating an LCD according to an embodiment of the present invention.

FIG. 4 is a schematic view illustrating an LCD according to an embodiment. Referring to FIG. 4, the LCD according to the embodiment of the present invention includes a liquid crystal display panel 110, a data driver 120, a gate driver 130, and a timing controller 150. The liquid crystal display panel 110 includes a plurality of gate lines GL1 to GLn, a plurality of data lines DL1 to DLm crossing the plurality of gate lines GL1 to GLn, and thin film transistors (TFTs) formed at regions where the gate lines GL1 to GLn and the data lines DL1 to DLm cross each other. Herein, the TFTs are used to drive liquid crystal cells Clc. The data driver 120 supplies a data signal to the data lines DL1 to DLm of the liquid crystal display panel 110. The gate driver 130 supplies a scan signal to the gate lines GL1 to GLn of the liquid crystal panel 110. The timing controller 150 controls the gate driver 130 and the data driver 120.

The LCD includes a gamma reference voltage generator 140 configured to supply a gamma reference voltage to the data driver 120, and a gamma reference voltage selector 141 configured to select the gamma reference voltage generated from the gamma reference voltage generator 140 according to a selection control signal SCS input from the timing controller 150.

Although not shown, the LCD further includes a backlight unit (not shown) configured to irradiate light onto the liquid crystal display panel 110, a common voltage generator (not shown) configured to generate a common voltage Vcom, and a power supply (not shown) configured to supply a power supply voltage to each element.

In the liquid crystal display panel 110, the TFT is formed as a switching element in each liquid crystal cell Clc. The TFT includes a gate electrode connected to one of the gate lines GL1 to GLn, a source electrode connected to one of the data lines DL1 to DLm, and a drain electrode connected to a pixel electrode of the liquid crystal cell Clc and an electrode of a storage capacitor Cst. A common voltage Vcom is applied to the common electrode of the liquid crystal cell Clc. The storage capacitor Cst maintains a voltage of the liquid crystal cell Clc constantly by charging the data voltage supplied from the data lines DL1, to DLm when the TFT is turned on.

When a scan pulse is sequentially supplied to the gate lines GL1 to GLn, the TFT is turned on to form a channel between the source and drain electrodes, thereby applying a voltage of the data line DL1 to DLm to the pixel electrode of the liquid crystal cell Clc. At this time, liquid crystal molecules of the liquid crystal cell Clc changes their arrangements due to an electrical field between the pixel electrode and the common electrode, thereby allowing incident light to be changed.

The data driver 120 supplies the data signal to the data lines DL1 to DLm in response to a data drive control signal DDC supplied from the timing controller 150. After sampling and latching image data (Data R, G, B) input from the timing controller 150, the data driver 120 converts the image data into analog data that can express a gradation in the liquid crystal cell Clc of the liquid crystal display panel 110 based on the gamma reference voltage supplied through the gamma reference voltage selector 141 from the gamma reference voltage generator 140, and thereafter supplies the analog data to the data lines DL1 to DLm.

Here, the data drive control signal DDC supplied from the timing controller 150 includes SSP, SSC, SOE, POL, and so forth.

The gate driver 130 sequentially generates the scan pulse according to a gate drive control signal GDC supplied from the timing controller 150 to thereby supply the scan pulse to the gate lines GL1 to GLn in sequence.

Here, the gate driver control signal GDC supplied from the timing controller 150 includes GSP, GSC, GOE, and so forth.

The timing controller 150 controls the data driver 120, the gate driver 130, and the gamma reference voltage selector 141 using vertical/horizontal synchronization signals Vsync/Hsync, a data enable signal DE, a clock signal clk, and data signals (Data R, G, B).

The gamma reference voltage generator 140 receives a high potential supply voltage VDD from a power supply (not shown) to generate a gamma reference voltage, and then output the gamma reference voltage to the data driver 120.

The gamma reference voltage selector 141 is further provided between the gamma reference voltage selector 141 and the data driver 120.

The gamma reference voltage selector 141 supplies the gamma reference voltage or a reference voltage of black gradation that is selected by the selection control signal SCS input from the timing controller 150.

The data driver 120 converts an image data to an analog signal using the reference voltage of black gradation or the gamma reference voltage selected by the gamma reference voltage selector 141, and then supplies the analog signal to the data lines DL1 to DLm.

At this time, the analog data output from the data driver 120 may be image data having image information or black data having black information.

Figure 5:
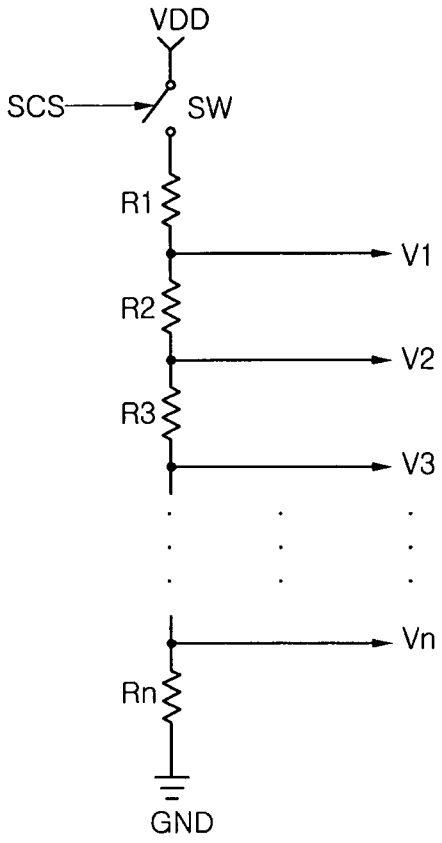
FIG. 5 is a detailed view illustrating a gamma reference voltage generator and a gamma reference voltage selector of FIG. 4.
Figure 6:
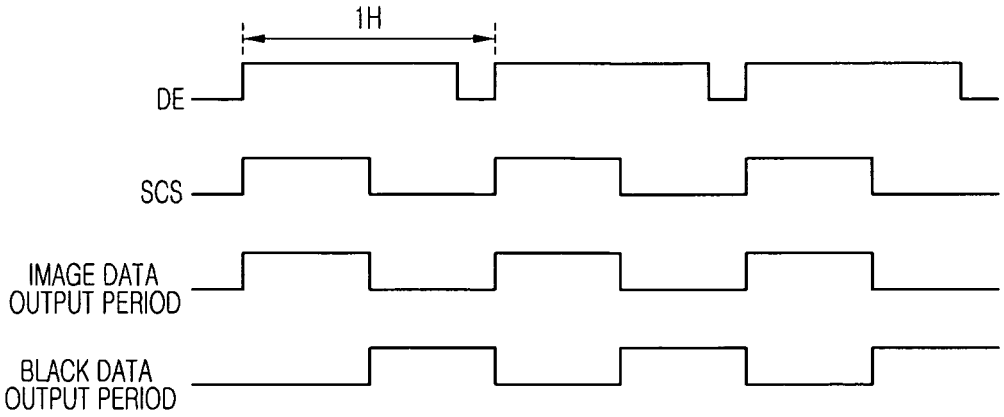
FIG. 6 is a view illustrating data signals output from a data driver of the embodiment.

FIG. 5 is a detailed view illustrating the gamma reference voltage generator 140 and the gamma reference voltage selector 141 of FIG. 4, and FIG. 6 is a view illustrating data signals output from the data driver 120 of the embodiment.

Referring to FIGS. 5 and 6, the gamma reference voltage generator of the embodiment includes a voltage division circuit. For example, the gamma reference voltage generator is provided with n number of resistors R1 to Rn between a high potential supply voltage (VDD) terminal and a ground voltage (GND) terminal. The gamma reference voltage generator generates gamma reference voltages V1 to Vn through voltage division nodes between the resistors R1 to Rn.

A switch SW is connected between the VDD terminal and the first resistor R1. In the embodiment, the switch SW may be defined as the gamma reference voltage selector.

The switch SW is turned on or off according to the selection control signal SCS of the timing controller.

A duration from a start point of a high level period of the data enable signal DE to a start point of a next high level period is defined as 1 horizontal period.

While the selection control signal SCS is at logic high level, the switch SW is turned on so that the gamma reference voltages (e.g., gamma reference voltages of 256 gray scales for displaying an image) generated by the gamma reference voltage generator are supplied to the data driver. At this time, the data driver converts image data into analog data voltage that can express a gradation in the liquid crystal cell based on the gamma reference voltage, and outputs the analog data voltage to the data lines.

Therefore, an image is displayed on the liquid crystal display panel when the selection control signal SCS is at logic high level.

When, however, the selection control signal SCS is at logic low level, the switch SW is turned off so that the gamma reference voltage generator supplies the reference voltage of black gradation to the data driver. At this time, the data driver outputs the black data to the liquid crystal cell based on the reference voltage of black gradation.

Therefore, a black image is displayed on the liquid crystal display panel when the selection control signal SCS is at logic low level.

Although it is illustrated that the data driver of the embodiment supplies the gamma reference voltage or the reference voltage of black gradation by turning-on or turning-off the switch SW, the present invention is not limited thereto. That is, it may also be possible to generate the reference voltage of black gradation during a low level period of the selection control signal SCS by connecting the ground voltage GND to the high potential supply voltage VDD or connecting the high potential supply voltage VDD to the ground voltage GND.

The display device according to the embodiment as described above outputs the normal gamma reference voltage to the data driver through the gamma reference voltage selector during a high level period and outputs the reference voltage of black gradation during a low level period according to the selection control signal of the timing controller. This makes it possible to improve a motion blurring phenomenon without employing a complicated circuit configuration.

Furthermore, in the black data insertion (BDI) method, the display device of the embodiment can reduce not only cost but also power consumption because it has a simpler structure than related art LCDs.

Although the description has been made on only the LCD in the aforesaid embodiment, the present invention is not limited thereto, and thus the display device of the embodiment is also applicable to other flat panel display devices.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device comprising:

a display panel including gate lines and data lines crossing each other to define a plurality of liquid crystal cells;

a gate driver to supply a scan signal to the gate lines sequentially;

a data driver to supply a data voltage to the data lines in a response to a data drive control signal;

a timing controller to drive the gate driver and the data driver based on at least a vertical synchronization signal and a horizontal synchronization signal that define a plurality of horizontal periods, with one horizontal period being defined by a duration from a start point of a high level period of a data enable signal to a start point of a next high level period; and a gamma voltage generator including a gamma voltage selector to supply a plurality of gamma reference voltages and a reference voltage of a black gradation to the data driver, wherein the timing controller controls the gamma voltage selector by generating a selection control signal based on at least the horizontal synchronization signal and supplying the selection control signal to the gamma voltage selector, and wherein one of the plurality of gamma reference voltages corresponding to an input image data and the reference voltage of the black gradation are alternated in each of the plurality of horizontal periods.

2. The display device according to claim 1, wherein the gamma reference voltage generator comprises:

a plurality of resistors connected in series between a high potential supply voltage terminal and a ground voltage terminal;

a gamma voltage output terminal through which the gamma reference voltage is output from a node between the plurality of resistors; and a switch connected between the high potential supply voltage terminal and the first resistor of the plurality of resistors.

3. The display device according to claim 2, wherein the switch is turned on or off according to the selection control signal.

4. The display device according to claim 3, wherein the gamma reference voltage is supplied to the data driver when the switch is turned on.

5. The display device according to claim 3, wherein the reference voltage of black gradation is supplied to the data driver when the switch is turned off.

6. The display device according to claim 1, wherein the gamma reference voltage generator comprises:

a plurality of resistors connected in series between a high potential supply voltage terminal and a ground voltage terminal; and a gamma voltage output terminal through which the gamma reference voltage is output from a node between the plurality of resistors, wherein the gamma reference voltage generator changes a high potential supply voltage to a ground voltage during a low level period of the selection control signal to generate the reference voltage of black gradation.

7. The display device according to claim 1, wherein the gamma reference voltage generator comprises:

a plurality of resistors connected in series between a high potential supply voltage terminal and a ground voltage terminal; and a gamma voltage output terminal through which the gamma reference voltage is output from a node between the plurality of resistors, wherein the gamma reference voltage generator changes a ground voltage to a high potential supply voltage during a low level period of the selection control signal to generate the reference voltage of black gradation.

8. The display device according to claim 1, wherein the reference voltage of black gradation is supplied to the data driver during a predetermined period of each horizontal period, wherein the data driver outputs a black data to the plurality of liquid crystal cells based on the reference voltage of black gradation during the predetermined period of each horizontal period, wherein the data drive control signal supplied from the timing controller includes SSP, SSC, SOE and POL, wherein the selection control signal is directly applied from the timing controller to the gamma voltage generator, and wherein the selection control signal is at logic low level for all periods in which a data enable signal and the gamma reference voltage are at logic low level, wherein the data enable signal defines the horizontal period.

* * * * *